US009004868B2

(12) United States Patent
Rhodes

(10) Patent No.: US 9,004,868 B2
(45) Date of Patent: Apr. 14, 2015

(54) INDUSTRIAL FAN IMPELLER HAVING A TAPERED BLADE AND METHOD

(75) Inventor: Matthew W. Rhodes, Mill Creek, IN (US)

(73) Assignee: The New York Blower Company, Willowbrook, IL (US)

( * ) Notice: Subject to any disclaimer, the term of this patent is extended or adjusted under 35 U.S.C. 154(b) by 1002 days.

(21) Appl. No.: 12/782,918

(22) Filed: May 19, 2010

(65) Prior Publication Data

US 2011/0286848 A1 Nov. 24, 2011

(51) Int. Cl.
*F04D 29/38* (2006.01)
*F04D 29/28* (2006.01)
*F04D 29/30* (2006.01)

(52) U.S. Cl.
CPC ..... *F04D 29/281* (2013.01); *F04D 29/30* (2013.01)

(58) Field of Classification Search
USPC ..... 29/889, 889.23, 889.4, 889.2; 415/206; 416/179, 182, 185, 186 R, 187, 188
See application file for complete search history.

(56) References Cited

U.S. PATENT DOCUMENTS

| | | | | |
|---|---|---|---|---|
| 5,964,576 | A * | 10/1999 | Fujita et al. | 415/206 |
| 5,967,747 | A * | 10/1999 | Burke et al. | 415/206 |
| 7,305,762 | B2 * | 12/2007 | Mola | 29/888.024 |
| 7,736,129 | B2 * | 6/2010 | Matsuo | 416/186 R |
| 8,007,240 | B2 * | 8/2011 | Sanagi et al. | 416/186 R |
| 2011/0023526 | A1 * | 2/2011 | Ohyama | 62/426 |

FOREIGN PATENT DOCUMENTS

| | | | | |
|---|---|---|---|---|
| JP | 2007-105653 A | * | 5/2007 | 416/186 R |
| WO | WO 2009/139422 A1 | * | 11/2009 | 415/206 |

* cited by examiner

*Primary Examiner* — Nathaniel Wiehe
*Assistant Examiner* — Woody A Lee, Jr.
(74) *Attorney, Agent, or Firm* — McCracken & Gillen LLC

(57) ABSTRACT

An industrial fan impeller that includes blades having an outer edge with a tapered portion and a level portion and method of manufacture are provided. The industrial fan impeller includes a front plate with a first diameter and a back plate with a second diameter larger than the first diameter of the front plate. Blades are attached to the front plate and the back plate. Individual blades have an outer edge with a tapered portion and a level portion. The blades are positioned between the front plate and the back plate such that the tapered portion of the outer edge of the individual blades tapers towards the front plate of the industrial fan impeller.

13 Claims, 3 Drawing Sheets

INDUSTRIAL FAN IMPELLER HAVING A TAPERED BLADE AND METHOD

FIELD OF THE INVENTION

This invention relates to a fan impeller for industrial fans and in particular to a fan impeller having blades with a tapered outer edge for modification of the air flow or the static pressure output of a fan.

BACKGROUND

Industrial processes may use centrifugal fans to supply relatively clean, dry air to industrial systems. Among the many applications that may require supply air include thermal oxidation, glass tempering, and waste water treatment. The size of the fan and the accompanying fan impeller may depend on the application in which the fan is used.

A conventional fan impeller may include a circular front plate, a circular back plate, and blades between the front and back plate. The front plate of the fan impeller may include a concentric, circular air inlet through which air enters the fan. The front plate may also form a curved lip around the periphery of the air inlet and around the periphery of the front plate itself. The curved lips may be formed by stamping the front plate in a die or spinning the front plate on dedicated tooling. The curved lips at the circumference of the air inlet and the front plate provide benefit with regard to air performance and strength by increasing stiffness. The back plate may be a similarly-sized, circular plate concentric with the front plate. Blades may be positioned between and attached to the front plate and the back plate. The blades of a conventional fan impeller may include an outer edge, conventionally known as a trailing edge, and an inner edge, conventionally known as a leading edge. Additionally, conventional fan impellers may be made of metal, such as steel, with the blades welded to the front plate and the back plate. A conventional fan impeller may also include a hub attached to the back plate to serve as the means of attachment of the fan impeller to a fan shaft.

Fan impellers are often described by the size of their inner diameter and outer diameter. The inner diameter is the length of the line segment passing through the center of the fan and terminating at the circumference of the air inlet. The outer diameter is the length of the line segment passing through the center of the fan and terminating at the circumference of the front plate or the back plate. The blades may have a length such that they may be positioned and extend between the inner diameter and outer diameter of the front plate and the back plate. The size of the outer diameter is a function of the blade length and will increase as the blade length increases.

The air flow and static pressure output of a fan may depend on the speed of the fan impeller, the blade width, or the blade length. It is often desirable to modify the air flow or static pressure output of a fan, for example, due to increased system demands. In situations where industrial fan systems are locked into a specific fan speed, modification of the fan impeller geometry may be one of very few, or possibly the only alternative to increase the air flow or the static pressure output. Conventional methods of modifying fan impellers include increasing the blade width or the blade length to modify the air flow or the static pressure output. Increases in blade length may require modifications to the diameters of the front and back plate in order to accommodate the longer blades.

However, increasing the outer diameter of the front plate may be a labor and cost-intensive process due to the curved lips formed around the circumference of the air inlet and the front plate. Conventional fabrication techniques may continuously weld a curved lip at the outer diameter of a flat, circular plate, which may then be used as a front plate. Alternatively, the stamping tooling may be disassembled and modified to create two separate inner and outer pieces with properly formed lips at the inner diameter and outer diameter. These pieces must then be continuously welded to join them as a single front plate. Thus, conventional fabrication methods may require special parts that demand tooling reconfigurations and modifications adding additional time and labor.

Methods to mitigate these difficulties have been attempted. One method that has been attempted modifies the outer edge of the blades, which only requires a modified back plate. A tapered outer edge is added to the blade such that the outer edge forms a slope between the front plate and the back plate.

The tapered outer edge results in a blade having one side edge longer than the corresponding opposite side edge. The shorter side edge of the blade is attached to the front plate, and the longer side edge is attached to the back plate, which eliminates the need to modify the front plate. Thus, only the back plate requires modification to accommodate the longer side edge of the blade. Because the back plate is fabricated via traditional metal cutting operations and not dedicated tooling, increase in labor for the manufacture of the back plate may be controlled.

However, while this method addresses the difficulty of modifying the front plate, the increase in the air flow or the static pressure output of the fan may be insufficient. Thus, it would be desirable to provide a fan impeller blade whose overall length may be increased without resource-intensive fabrication methods that provide for further improvements to and fine tuning of the air flow or the static pressure output of the fan.

DETAILED DESCRIPTION

An industrial fan impeller and method of manufacture to modify the air flow or the static pressure output of an industrial fan is described herein. In particular, the industrial fan impeller includes blades having an outer edge with a tapered portion and a level portion.

An industrial fan impeller that includes blades having an outer edge with a tapered portion and a level portion and method of manufacture are described herein. An industrial fan impeller includes a front plate with a first diameter and a back plate with a second diameter larger than the first diameter of the front plate. Blades are attached to the front plate and the back plate. Individual blades have an outer edge with a tapered portion and a level portion. The blades are positioned between the front plate and the back plate such that the tapered portion of the outer edge of the individual blades tapers towards the front plate of the industrial fan impeller.

A method of manufacturing an industrial fan impeller as described herein includes: providing a front plate having a first diameter; providing a back plate having a second diameter larger than the first diameter of the front plate; providing blades having an outer edge with a tapered portion and a level portion; positioning the blades between the front plate and the back plate such that the tapered portion of the outer edge tapers towards the front plate; and attaching the blades to the front plate an the back plate.

Figure 1:
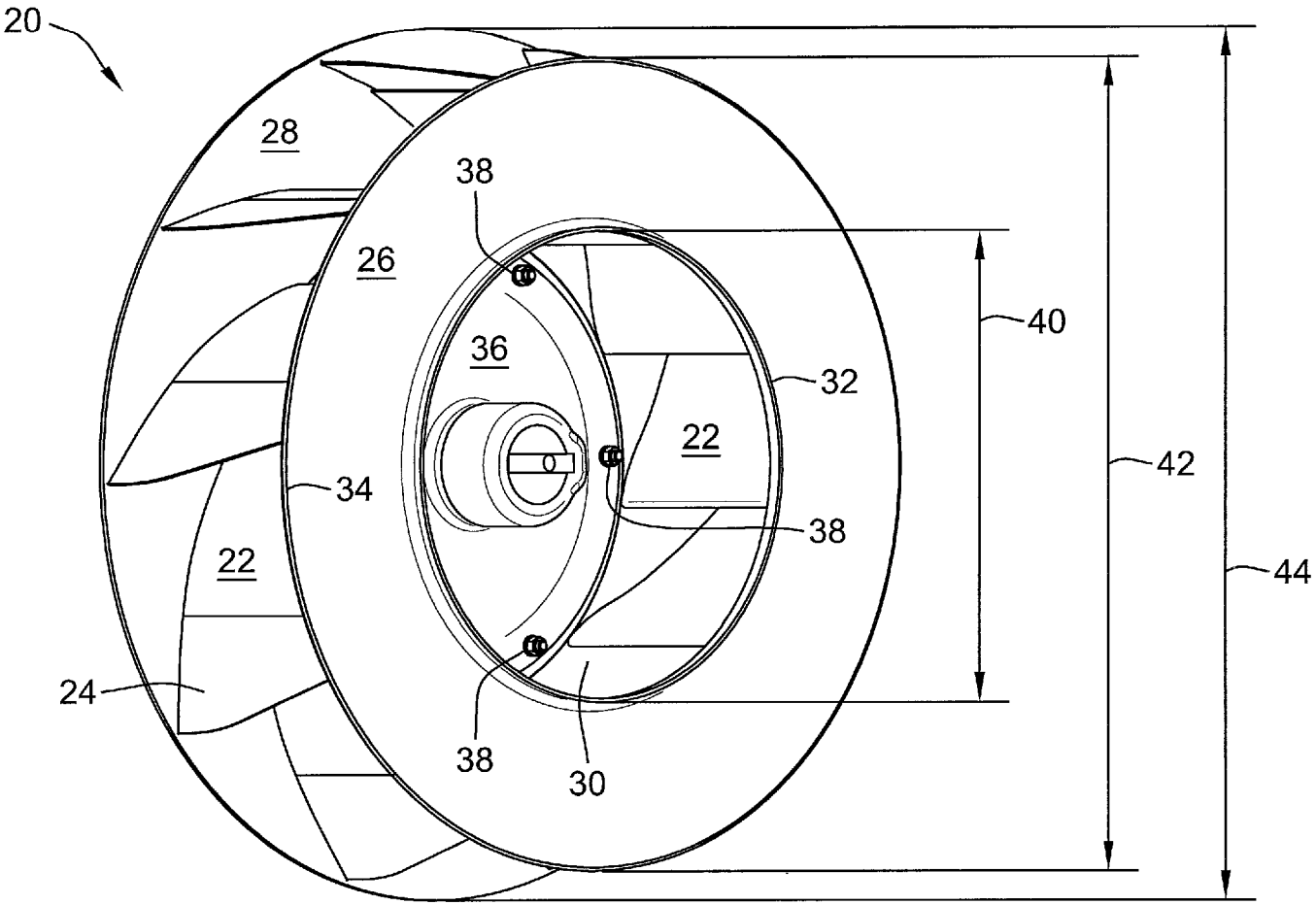
FIG. 1 is a perspective view of an example fan impeller having an over diameter design and airfoil blades with tapered outer edges.

Referring to FIG. 1, an example fan impeller 20 having blades 22 with tapered outer edges 24 is shown. The example fan impeller includes a front plate 26, a back plate 28, and multiple tapered blades 22 positioned between and attached to the front plate and the back plate. The outer edge 24 of the blades 22 are tapered to provide an increased overall blade length, thus improving the air flow or the static pressure output, while preserving the use of a standard front plate 26. Further, the shape of the tapered outer edge 24, as described below, provides for further improvements to and fine tuning of the air flow and static pressure output of a fan as compared to conventional tapered blade designs.

The front plate 26 of the fan impeller 20 is a substantially flat, circular disc. The front plate 26 includes an air inlet 30 through which air enters the fan impeller. The front plate also includes a curved lip 32 formed around the periphery of the air inlet 30 and a lip 34 is formed around the periphery of the front plate 26 itself.

The back plate 28 of the fan impeller seen in FIG. 1 is a flat, circular disc. A hub 36 may be attached to the back plate 28 with multiple bolts 38. The hub 36 serves as the means of attachment of the fan impeller 20 to a fan shaft. When attached to a fan shaft and installed in an industrial fan, the fan impeller seen in FIG. 1 may rotate clockwise during operation.

The fan impeller 20, in the example shown, also includes multiple blades 22. The blades 22 may have an airfoil shape and be attached to and positioned between the front plate 26 and the back plate 28 as shown. In the example shown, the components of the fan impeller 20 are made of steel, and thus the blades 22 are welded to the rear of the front plate 26 and the face of the back plate 28. Those skilled in the art will recognize that alternative blade shapes, composite materials, and means of attachment may be employed with regards to the components of a fan impeller as described herein.

Figure 2:
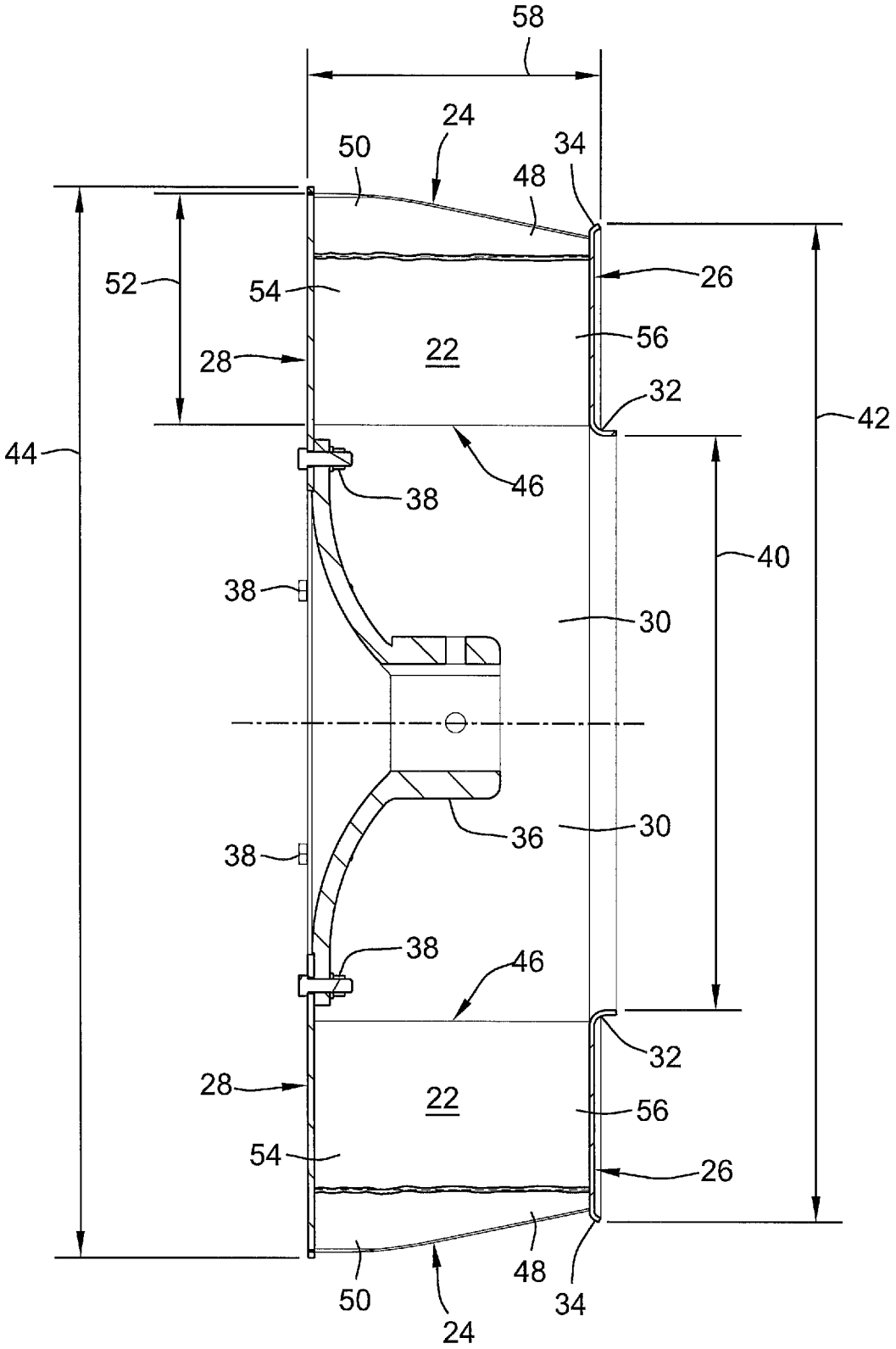
FIG. 2 is a side cross-sectional view of the example fan impeller of FIG. 1.

Referring now to FIG. 2, a side cross-sectional view of the fan impeller 20 of FIG. 1 is shown. As seen in FIG. 2, the front plate 26 includes an inner diameter 40 and an outer diameter 42. The inner diameter 40 is the length of the line segment passing through the center of the front plate 26 and terminating at the periphery of the air inlet 30. The outer diameter 42 is the length of the line segment passing through the center of the front plate 26 and terminating at the edge of the front plate.

The back plate also includes a diameter 44 as seen in FIG. 2. Because the diameter 44 of the back plate 28 is larger than the outer diameter 42 of the front plate 26, the diameter of the back plate is referred to as an over diameter. The over diameter 44 is the length of the line segment passing through the center of the back plate 28 and terminating at the edge of the back plate. The over diameter 44 of the back plate 28 may alternatively be measured from the tip of a blade 22 to the tip of a diametrically opposed blade as the blades of the fan impeller 20 may not fully extend to the periphery of the back plate as seen in FIG. 2. The over diameter 44 of the back plate 28, in the example shown, is larger than the outer diameter 42 of the front plate 26 in order to accommodate the tapered blade design described below.

A particular over diameter for a back plate may be described as a percentage of the outer diameter of a front plate. For example, a fan impeller as described herein may have an over diameter of approximately 104% meaning the over diameter of the back plate is approximately 1.04 times the length of the outer diameter of the front plate. The size of the over diameter may be limited by the design and size of the housing of an industrial fan. Accordingly, in some industrial fans, the over diameter of the back plate may be up to but no more than 108% the size of the front plate.

Also seen in FIG. 2, the blades have an inner edge 46 and an outer edge 24. The inner edge 46 is the edge of the blade 22 nearest to the air inlet 30; the outer edge 24 is the edge of the blade 22 nearest to the periphery of the back plate 28. The inner edge 46 may be substantially level as it extends between the front plate 26 and the back plate 28. The outer edge 24 exhibits a tapered design such that the outer edge includes a tapered portion 48 and a level portion 50.

The blades 22 of the fan impeller 20 are positioned between the front plate 26 and the back plate 28 such that the outer edge 24 of the blade tapers towards the front plate. The blades 22 are oriented such that the tapered portion 48 of the outer edge 24 is positioned next to the front plate 26 and the level portion 50 of the outer edge is positioned next to the back plate 28. In this orientation, the tapered portion 48 of each blade 22 meets the front plate at an oblique angle relative to the front plate, and the level portion 50 meets the back plate at a substantially perpendicular angle relative to the back plate 28 as seen in the example in FIG. 2.

The blade 22 is also defined by a length and a width. The inner edge 46 and outer edge 24 define the overall length 52 of the blade as measured from the inner edge to the level portion 50 of the outer edge. The tapered design of the outer edge 24 results in a blade having one side edge 54 longer than the corresponding opposite side edge 56. As seen in FIG. 2, the tapered portion 48 of the outer edge 24 slopes away from the level portion 50 and towards the shorter side edge 56 of the blade 22. Thus, the blade length 52 is largest as measured from the inner edge 46 of the blade to the level portion 50 of the tapered outer edge 24. The blade also includes a blade width 58 defined by the distance between the front plate 26 and the back plate 28.

As mentioned above, the length and width of a fan impeller blade may be factors in the air flow or the static pressure output of a fan. However, the fan impeller 20 having a tapered outer edge 24 described herein provides for additional fan impeller characteristics that may be used to adjust and fine tune the air flow or static pressure output of the fan: the width of the level portion 50 of the outer edge 24 and the over diameter percentage.

The width of the level portion 50 may be adjusted to provide an appreciable amount of blade surface area in the region of the fan where the volume of air moving through the fan impeller 20 is significant. Thus, the amount of surface area in this region may be adjusted by providing a wider or narrower level portion 50 on the tapered outer edge 24. The relative width of the level portion 50 of the outer edge 24 of a blade 22 may be, in one example, between 20% and 30% the overall width of the blade, and, in a more particular example, approximately 25% (one-fourth) of the overall width 58 of the blade. In other embodiments, the relative width of the level portion 50 may range up to 50% (one-half) of the overall width 58 of the blade 22.

Alternatively, the over diameter percentage may be adjusted to modify the air flow or static pressure output of the fan. Increasing the over diameter 44 requires an increase in the longer side edge 54 of the blade 22, which also provides greater surface area on the blade. The over diameter percentage may range, for example, up to 108% of the outer diameter 42 of the front plate 26. Those skilled in the art will recognize that the over diameter 42 of the back plate 28 may be limited by the particular design and dimensions of the fan housing.

Blade width of the fan impeller may be adjusted such that the air flow or static pressure output may be improved. For example, in an embodiment, a fan impeller may provide a blade having a smaller overall width in order to provide a lower air flow requirement.

A method of manufacture may be used to fabricate the fan impeller with blades having a tapered outer edge as described herein. By limiting the need of an over diameter to the easily fabricated back plate and blades, the method of manufacture provides for the use of standard components, such as a standard front plate, and eliminates the need for tooling reconfigurations.

With reference to the fan impeller 20 seen in FIG. 2, a standard front plate 26 is provided having curved lips 32 and 34 at the periphery of the air inlet 30 and the periphery of the front plate 26 respectively. Multiple blades 22 are provided for attachment to the front plate 26 as seen in FIG. 2. The provided blades 22 may be airfoil in shape and include a tapered outer edge 24 as shown and described.

Each blade 22, in the example shown, may be fabricated to include a tapered outer edge 24, which further includes a tapered portion 48 and a level portion 50 as described above. Blades 22 may be fabricated, for example, via traditional metal cutting operations and formed into an airfoil or other desirable shape. The tapered portion 48 may be positioned next to the front plate 26 such that the tapered portion meets the front plate at an oblique angle. Accordingly, the level portion 50 may be positioned next to the back plate 28 such that the level portion perpendicularly meets the back plate. As discussed above, the components of the fan impeller 20 seen in FIG. 2 are made of steel. Thus, the blades 22 are welded to the rear of the front plate 26 and the face of the back plate 28. Those skilled in the art will recognize that alternative blade shapes, composite materials, and means of attachment may be employed to fabricate the fan impeller described herein.

To accommodate the increase in the overall length of the blades 22 beyond the outer diameter 42 of the front plate 26, a back plate 28 having an over diameter 44 is provided. The over diameter 44 of the back plate 28 should be larger than the outer diameter 42 of the front plate 26 and be large enough to accommodate the increased overall length of the blades.

During fabrication of the fan impeller 20, the blades 22 are attached to the back plate 28 having an appropriate over diameter 44. As mentioned above, the back plate 28 and blades 22 of the fan impeller 20, in the example shown, are made of steel, and thus the blades are welded to the face of the back plate. If the fan impeller 20 will be attached to a fan shaft, a hub 36 may be attached to the back plate 28 by way of bolts 38 or other means of attachment known to those skilled in the art. Once fabricated, the fan impeller 20 is available for use in an industrial fan to improve the air flow or static pressure output of the fan.

Figure 3:
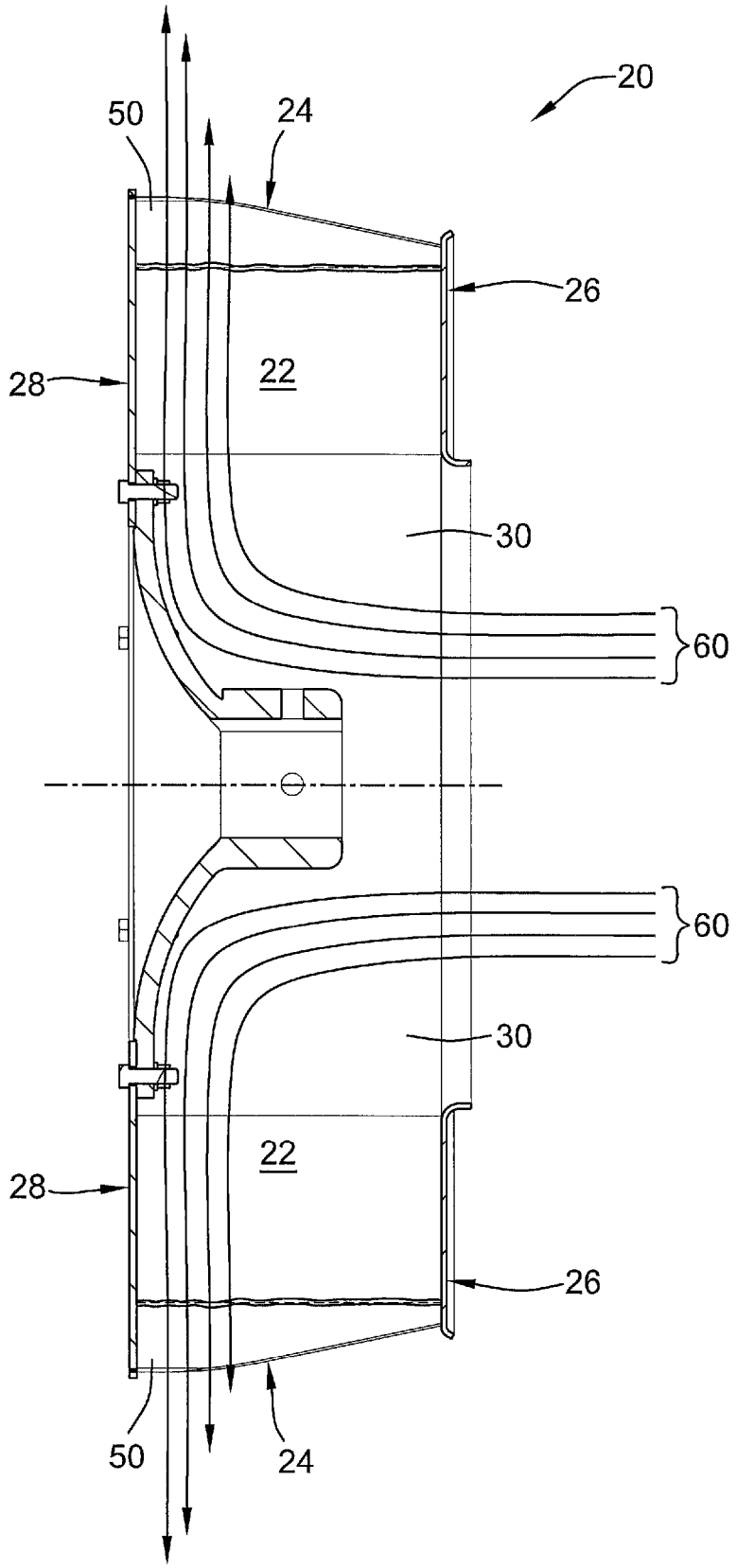
FIG. 3 is a side cross-sectional view of an example fan impeller having an over diameter design and blades with tapered outer edges illustrating the airflow across blades of the impeller.

As seen in FIG. 3, the fan impeller 20 further improves the air flow or the static pressure output by taking into account the path of the air 60 as the air moves through the fan impeller. As illustrated, air 60 enters the fan impeller through the air inlet 30 and typically travels to the rear of the fan towards the back plate 28 of the fan impeller. Thus, the volume of air 60 is typically greatest near the back plate 28 and the level portion 50 of the blades. Accordingly, positioning the level portion 50 next to the back plate 28 provides an increased amount of blade surface area where the volume of air is greatest. By increasing the surface area of the outer edge 24 where the airflow is typically greatest, the blades 22 of the fan impeller 20 may move a higher volume of air. Thus, the air flow and/or static pressure output of the fan is improved.

The industrial fan impeller blade and method of manufacture taught herein improves conventional techniques for improving the air flow or the static pressure output of a fan. While conventional techniques may require tooling reconfigurations and modifications to fabricate the front plate, the method of manufacture described herein eliminates the need to modify the front plate of the fan impeller. Instead, the method allows manufacturers to maintain standard components and provides for the simple fabrication of an over-diameter back plate and blades by way of conventional plasma or laser cutting operations.

Incorporating the tapered blade design provides for the use of a standard front plate thereby eliminating material, tooling, and labor cost increases associated with fabricating an over diameter front plate. The tapered blade may be formed with a standard blade die without tooling modifications or an increase in labor time. By eliminating extra cost and labor, the over diameter fan impeller may be offered as a cost-effective solution to fine-tuning the air flow or the static pressure output of a fan with no increase in manufacturing lead time.

The tapered blade design described herein improves the air flow and/or static pressure output of a fan by taking into account the path of the airflow through the fan. By leveling off the slope of the tapered outer edge of the blade such that the outer edge perpendicularly meets the back plate, the blade provides a greater amount of surface area where the air flow is typically greatest. Thus, the tapered blade design achieves better improvements to the air flow or the static pressure output than alternative tapered blade designs.

Furthermore, the fan impeller described provides additional parameters to fine tune the air flow or static pressure output of a fan: the over diameter percentage and the width of the level portion of the tapered outer edge of the blade. Modifications to the air flow and static pressure output of fans having traditional fan impellers may be limited to adjustments of the blade length and the blade width. As a result, such adjustments to traditional fan impeller geometries may be limited by the particular design and dimensions of the fan housing. The improved fan impeller introduces a new parameter that provides another option for fine tuning the air flow or static pressure output of a fan that mitigates the limitations imposed by the housing of a fan. By including a level portion on the outer edge of a blade, modifications to the air flow and static pressure output are not as constrained by the dimensions of the fan housing.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain details described herein can be varied considerably without departing from the basic principles of the invention.

What is claimed is:

1. An industrial fan impeller for supplying a volume of air flow to industrial systems comprising:

a front plate having a first diameter, the front plate having an inner flat surface and an air inlet through which air enters the fan impeller, and the front plate having a curved lip formed around the periphery of the air inlet;

a back plate having a second diameter larger than the first diameter;

a plurality of blades attached to the front plate and the back plate, the blades having an outer edge with a tapered portion and a level portion, the blades are positioned between the front plate and the back plate such that the tapered portion of the outer edge tapers towards and is adjacent to the front plate wherein the tapered portion of the individual blades meets the fiat surface of the front plate at an oblique angle relative to the front plate and the level portion meets the back plate at a substantially perpendicular angle relative to the back plate, and the blades are positioned such that the level portion of the outer edge is positioned adjacent to the back plate in a region of the fan impeller where the volume of air moving through the fan impeller is greatest to increase static pressure output of air flow from the fan impeller, wherein the blades have an inner edge positioned proximate to the air inlet, the inner edge is substantially level as it extends between the front plate and the back plate, and wherein the distance between the inner edge and the outer edge define a length of the blade wherein the blade length is largest as measured from the inner edge to the level portion of the outer edge and wherein the tapered portion of the individual blades attach with the fiat surface of the front plate such that an increase to the blade length is configurable when fabricating the impeller without changing the configuration of the front plate.

2. The industrial fan impeller of claim 1 wherein the individual blades have one side edge and an opposite side edge such that the one side edge is longer than the opposite side edge and wherein the tapered portion of the outer edge of the blade slopes away from the level portion and towards the shorter opposite side edge of the blade.

3. The fan impeller of claim 1 wherein the second diameter is no more than 108% the size of the first diameter.

4. The fan impeller of claim 1 wherein the second diameter is approximately 104% the size of the first diameter.

5. The fan impeller of claim 1 wherein the width of the level portion of the outer edge of each of the blades is no more than 50% the width of the blade.

6. The fan impeller of claim 5 wherein the width of the level portion of the outer edge of each of the blades is between 20% and 30% the width of the blade.

7. The fan impeller of claim 6 wherein the width of the level portion of the outer edge of each of the blades is approximately 25% the width of the blade.

8. The fan impeller of claim 1 wherein the blades are airfoil in shape.

9. The fan impeller of claim 1 wherein the front plate, the back plate, and the blades are made of steel.

10. The fan impeller of claim 9 wherein the blades are welded to the front plate and the back plate.

11. A method of manufacturing an industrial fan impeller for supplying a volume of air flow to industrial systems comprising the steps of:

providing a front plate having a first diameter, the front plate having an inner flat surface and an air inlet through which air enters the fan impeller, and the front plate having a curved lip formed around the periphery of the air inlet;

providing a back plate having a second diameter larger than the first diameter;

providing a plurality of blades having an outer edge with a tapered portion and a level portion;

positioning the plurality of blades such that the tapered portion of the individual blades meets the flat surface of the front plate at an oblique angle relative to the front plate and the level portion of the individual blades meets the back plate at a substantially peipendicular angle relative to the back plate;

positioning the blades between the front plate and the back plate such that the tapered portion of the outer edge tapers towards and is adjacent to the front plate;

positioning the level portion of the individual blades adjacent to the back plate and in an area of the industrial fan impeller where the volume of an moving through the fan is greatest so as to provide an increased amount of surface area on the individual blades for moving the air and to increase static pressure output of air flow from the fan impeller;

positioning an inner edge of the blades proximate to the air inlet wherein the inner edge is substantially level as it extends between the front plate and the back plate, and wherein the distance between the inner edge and the outer edge define a length of the blade wherein the blade length is largest as measured from the inner edge to the level portion of the outer edge and wherein the tapered portion of the individual blades attach with the flat surface of the front plate such that an increase to the blade length is configurable when fabricating the impeller without changing the configuration of the front plate; and attaching the blades to the front plate and the back plate.

12. The method of claim 11 further comprising forming each blade into an airfoil shape.

13. The method of claim 11 wherein the front plate, the back plate, and the blades are made of steel and the step of attaching the blades to the front plate and the back plate includes the step of welding the blades to the front plate and the back plate.

* * * * *